United States Patent [19]

Jensen

[11] Patent Number: 4,514,867

[45] Date of Patent: May 7, 1985

[54] WHEEL CHAIR WITH DISPLACEABLE SEAT PANEL

[76] Inventor: Neil B. Jensen, W. 339, N. 5175, Rd. O, Nashotah, Wis. 53058

[21] Appl. No.: 567,062

[22] Filed: Dec. 30, 1983

Related U.S. Application Data

[63] Continuation-in-part of Ser. No. 348,530, Feb. 12, 1982, abandoned.

[51] Int. Cl.[3] ..... A61G 7/02

[52] U.S. Cl. ..... 4/480; 297/DIG. 4

[58] Field of Search ..... 4/478–480, 4/483; 297/DIG. 4, 118, 440, 192, 193; 280/289 WC, 242 WC

[56] References Cited

U.S. PATENT DOCUMENTS

| | | | |
|---|---|---|---|
| 559,109 | 4/1896 | Stoltz | 4/483 |
| 2,086,550 | 7/1937 | Hartig | 4/480 |
| 2,748,834 | 6/1956 | Schwinn | 4/480 X |
| 3,061,368 | 10/1962 | Matthews | 4/480 X |
| 3,062,582 | 11/1962 | Baldwin | 4/480 X |
| 3,186,759 | 6/1965 | Reeves | 4/483 X |
| 3,271,785 | 9/1966 | Du Bose | 4/480 |
| 3,654,643 | 4/1972 | Clanan | 5/81 B |
| 4,103,969 | 8/1978 | Glessner | 297/440 X |
| 4,343,482 | 8/1982 | Wegner | 297/DIG. 4 X |

*Primary Examiner*—Charles E. Phillips

*Attorney, Agent, or Firm*—Fuller, House & Hohenfeldt

[57] ABSTRACT

A seat construction for a wheel chair includes a pivoted central panel and a handle and linkage for pivoting the panel from an occupant supporting position to an open position which enables the wheel chair to be wheeled over a conventional toilet for use thereof without transfer of the occupant from the wheel chair. The seat is clamped to the side frames of a conventional wheel chair. The linkage includes an over center action to lock the central panel in the closed position.

5 Claims, 8 Drawing Figures

10

14
12
22
23
23
30
34
22
70
57
74
90
86
72
80
84
52
52
20
32
75
66
64
54
16
36
56
18
20
16
18

WHEEL CHAIR WITH DISPLACEABLE SEAT PANEL

CROSS REFERENCE TO RELATED APPLICATION

This application is a continuation-in-part of application Ser. No. 348,530, filed Feb. 12, 1982 now abandoned.

BACKGROUND OF THE INVENTION

Various attempts have been made in the prior art to develop a wheel chair which enabled the user of the wheel chair to use a toilet without being moved from the wheel chair. U.S. Pat. Nos. 3,061,368 and 2,086,550 are illustrative of wheel chair constructions for this purpose. For various reasons, none of the prior art constructions have reached the marketplace to benefit the handicapped users of wheel chairs.

SUMMARY OF THE INVENTION

The invention provides a convertible wheel chair seat which is readily substituted for the seat of a conventional collapsible wheel chair. A central panel for the seat is movable by the occupant between a closed position for supporting the occupant and an open position which enables the wheel chair to be wheeled into a position over a conventional toilet for use thereof without transfer of the occupant from the wheel chair.

The conventional wheel chair seat and the folding assembly which holds the side frames together is removed. The wheel chair seat of the invention is readily clamped to the wheel chair side frames by forward and rear frame parts which span the gap between the side frames, support the seat panels and are clamped to the side frames. The central panel is fixedly connected to a pivot shaft which pivotally supports the central panel for movement between an occupant supporting closed position co-planar with adjacent seat panels and a downward and forward position which opens the gap between the unpivoted adjacent panels to form a toilet aperture. Manipulation of the central panel between the positions is afforded by a manually operable linkage which includes a crank arm fixed to the pivot, a first link which is pivotally connected to the crank arm and a second link which is pivotally connected to the rear seat frame section. The second link has a handle located laterally outwardly of the seat and arm rest and accessible by the occupant. The links and link pivots are arranged so that the lever provides an over center action in the closed position to lock the center panel in the supporting position for conventional closed seat usage.

Further objects, advantages and features of the invention will become apparent from the disclosure.

DESCRIPTION OF THE PREFERRED EMBODIMENT

Although the disclosure hereof is detailed and exact to enable those skilled in the art to practice the invention, the physical embodiments herein disclosed merely exemplify the invention which may be embodied in other specific structure. The scope of the invention is defined in the claims appended hereto.

Figure 1:
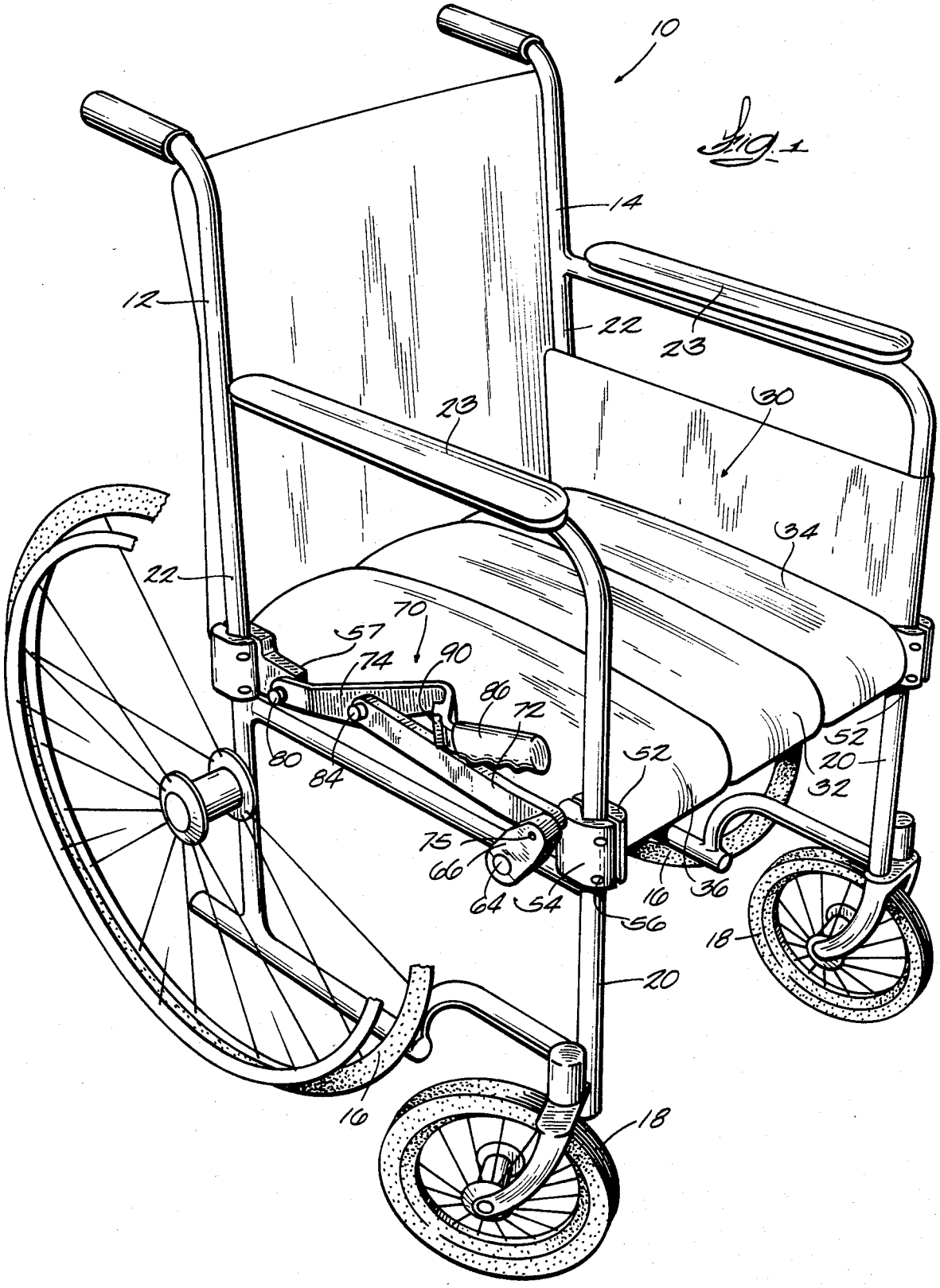
FIG. 1 is a perspective view of a wheel chair embodying the seat of the invention.

In the drawings, FIG. 1 shows a wheel chair 10 having a pair of spaced side frames 12 and 14 which are supported by rear wheels 16 and front wheels 18. The side frames include front legs 20 and rear legs 22 and arm rests 23. As thus far described, the wheel chair is conventional. Typically, the wheel chair has a foldable or flexible seat and a collapsible linkage connecting and spacing the side frames so the wheel chair can be collapsed and put in the trunk of a vehicle.

In accordance with the invention, there is provided a seat assembly 30 for the conventional wheel chair. The seat assembly includes a central panel 32 located intermediate to the side panels 34 and 36. All of the panels 32, 34 and 36 are rigid and can be upholstered and cushioned for comfort. It is noted that when employing the seat assembly of the invention the wheel chair cannot be collapsed without removal of the seat.

The panels 32, 34 and 36 are supported between the side frames by two seat supporting frame elements 40 and 42. As disclosed, the seat supporting frame elements 40, 42 are identical castings made from the same mold. The castings include two end portions 46 and 48 at the ends of the elongated casting interconnected by a central web portion 50, with the end portions having integrally formed bracket half sections 52 oriented so that the bracket half sections cooperate with separable bracket half sections 54 (FIG. 4) to embrace the tubing of the frame side sections. Bolts 56 secure the clamp half sections together.

The brackets are also provided with mounting ear portions 57 for supporting parts of the linkage, as hereinafter described.

Figure 4:
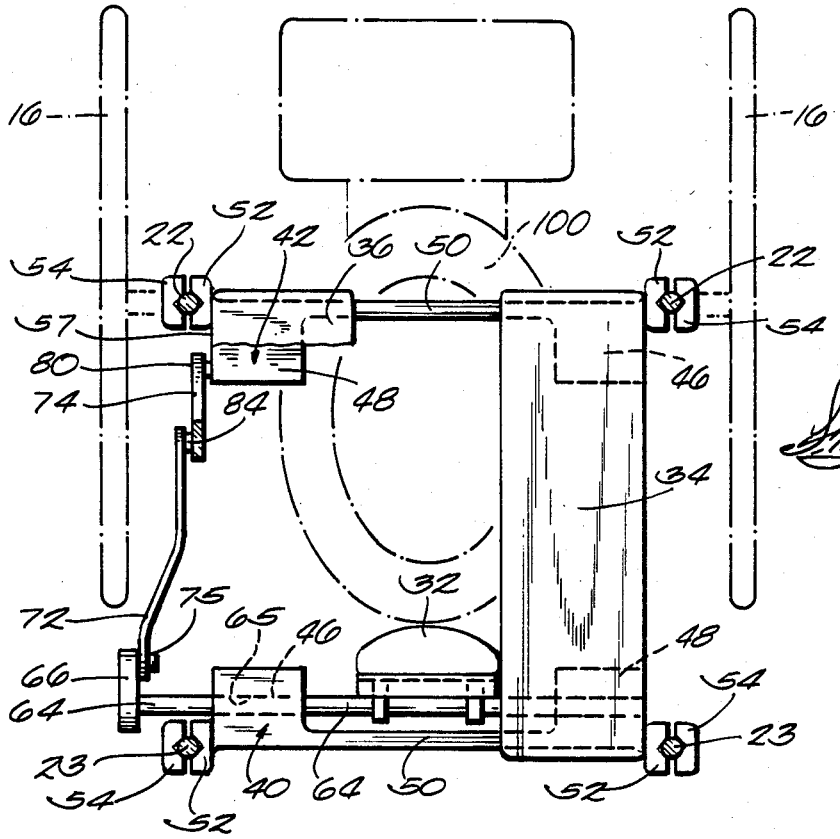
FIG. 4 is a view along lines 4—4 of FIG. 3.
Figure 5:
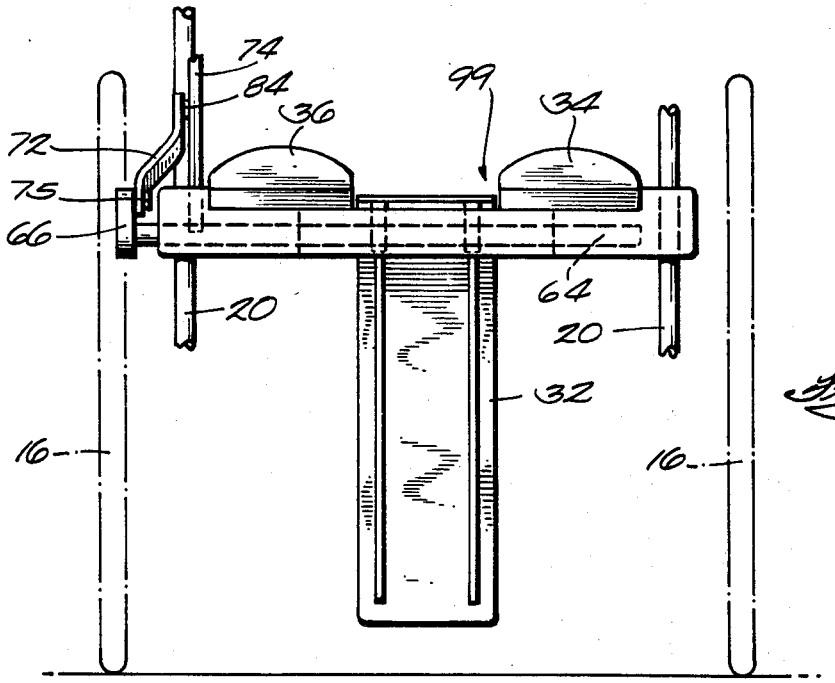
FIG. 5 is a front view of the chair shown in FIG. 3 at the same scale as FIG. 4 with the center seat panel in the open position.

The side seat panels 34 and 36 can be screwed to the frame parts by screws (not shown). The center panel 32 is fixed to pivot shaft or rod 64. The pivot shaft 64 (FIGS. 4 and 5) is journalled for rotation in apertures 65 in the spaced end portions 48, 46 of the forward frame. The rod 64 projects laterally on the right side of the wheel chair. A crank arm 66 is fixed to the pivot shaft 64 and is part of a toggle linkage 70 which enables manual operation of the device to raise and lower the panel 32. The linkage 70 also includes a first link 72 (FIG. 1) which is pivotally connected at 75 to the crank arm 66 and a second link 74 which is pivotally connected to the mounting ear 57 by a pin or threaded bolt 80. The links 72, 74 are commonly pivotally connected by a pivot pin 84. The link 74 is provided with a handle portion 86 which is accessible for manipulation by the chair occupant. The link 74 is shaped or bent as shown in FIGS. 1 and 4 so that the handle 86 swings outwardly of and clears the arm rest.

Figure 2:
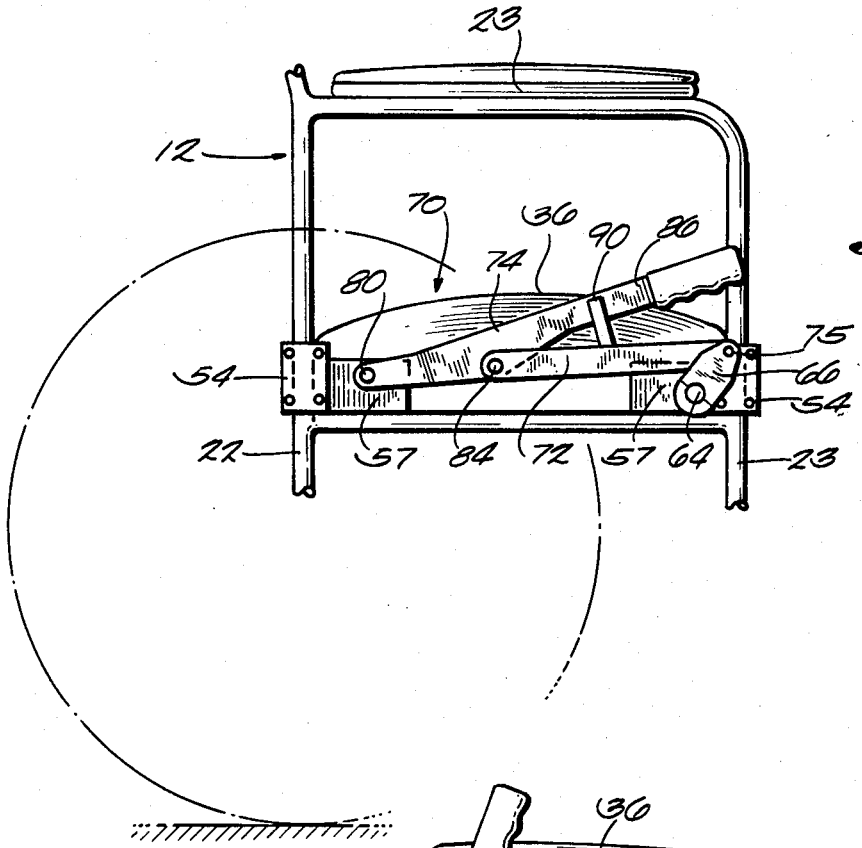
FIG. 2 is a fragmentary side elevational view of the central seat panel shown in FIG. 1 in the closed position.
Figure 3:
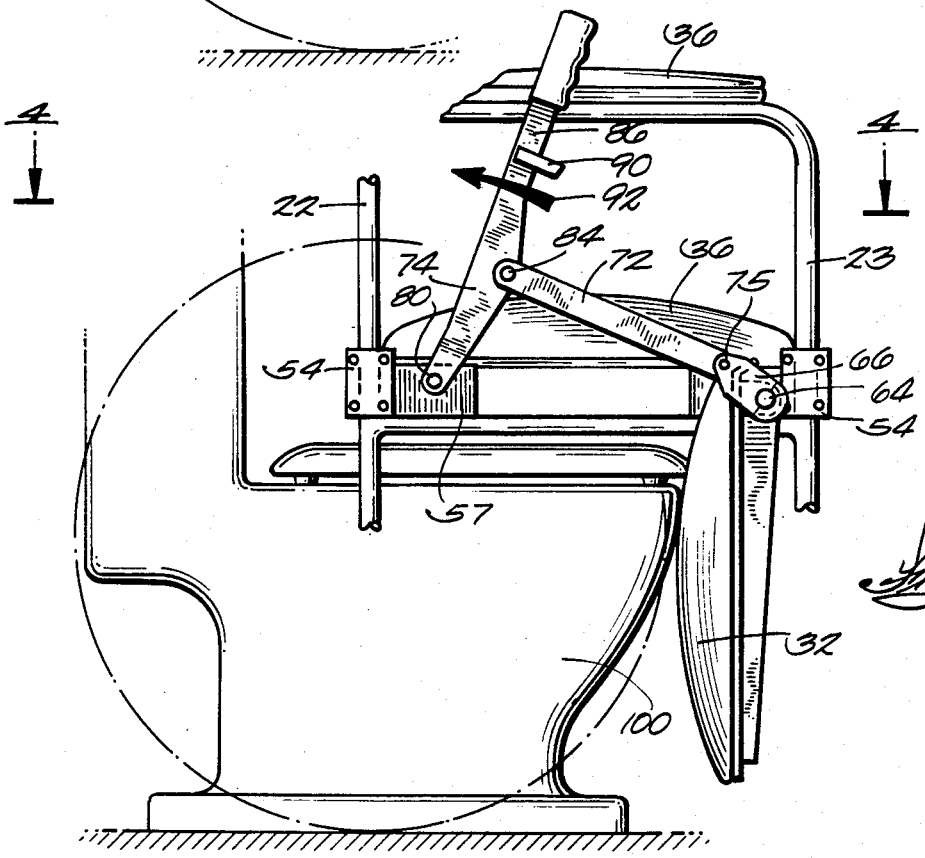
FIG. 3 is a view similar to FIG. 2 showing the center seat panel in the open position.

The linkage is arranged so that in the closed position, as shown in FIGS. 1 and 2, the links are in an over center locking position which maintains the panel 32 in the closed position to support the occupant. Most of the load of the occupant is carried by the side panels 34, 36. However, when the center panel 32 is locked in the closed position it is sufficiently rigid to provide support although it is cantilevered from the rod 64 when it is locked against rotation. A stop 90 on the link 74 controls the extent of over center condition. When swinging the handle 86 through an arc 92, as shown in FIG. 3, the toggle is broken and the link leaves the over center locking condition and continued movement of the handle pivots the central panel 32 to the FIG. 3 open position, providing a slot 99 over the toilet bowl 100. The FIG. 3 open position is sufficiently forward so that the wheel chair can be backed over the usual toilet bowl 100. There is no frame structure beneath the seat to interfere with positioning of the wheel chair as shown in FIG. 3.

Figure 6:
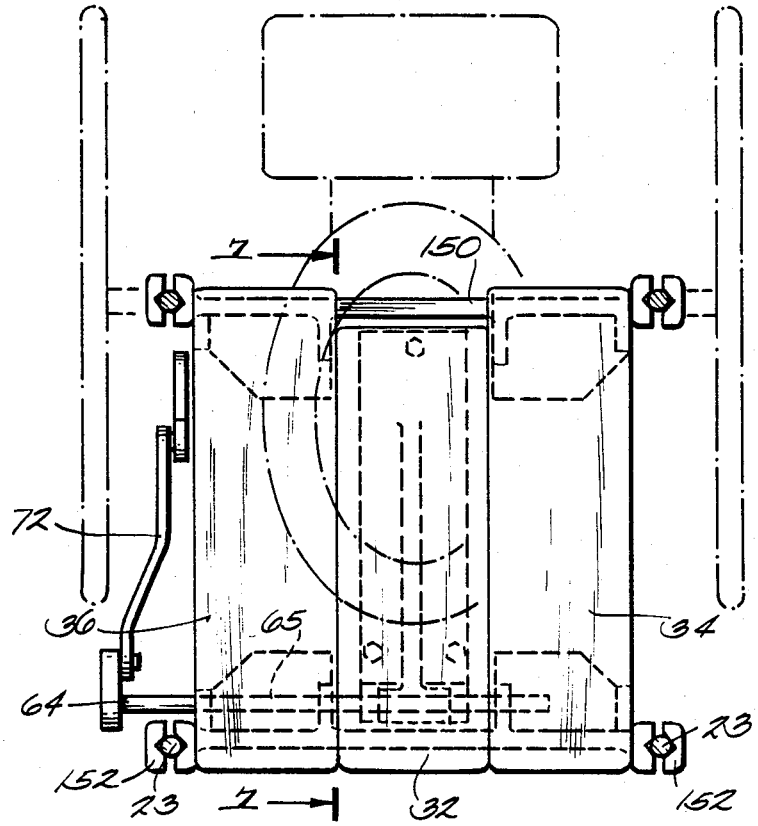
FIG. 6 is a view of the underside of the seat similar to FIG. 4 of a modified embodiment of the invention.
Figure 7:
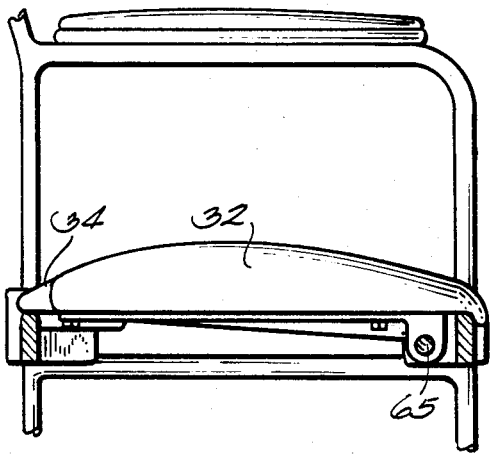
FIG. 7 is a sectional view along lines 7—7 of FIG. 6.
Figure 8:
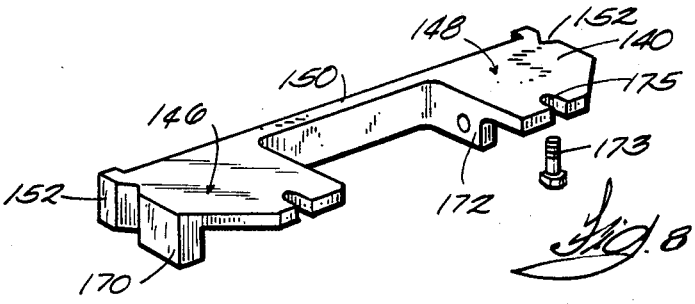
FIG. 8 is a perspective view of the casting which interconnects the panels in the modified embodiment.

FIGS. 6, 7 and 8 show a modified embodiment of the invention in which a casting 140 is employed to connect and support the seat panels 32, 34, 36 and the toggle linkage 70 and the other parts. The casting 140 includes a thin web 150 which interconnects heavy portions 146, 148 which have clamp parts 152. The casting 140 performs the same functions as the corresponding parts of the embodiment of FIGS. 1, 2, 3. The casting 140, when employed in the front of the wheel chair as illustrated in FIG. 6, is provided with apertures 65 to rotatably receive the shaft or rod 64. The casting 140 includes strengthening ribs 170 and 172 to rigidify the casting 140. The seat panels 34, 36 are secured to the castings by bolts 173 which extend through slots 175 in the casting 140.

As illustrated in FIG. 6, the central panel 32 is shorter than the other panels 34, 36 and clears the web 150 when the panel 32 is moved into the closed position.

I claim:

1. In a wheel chair construction including a chair frame having spaced side frames supported on wheels, the improvement comprising a seat frame, means for detachably securing said seat frame between and to said side frames, a first seat panel and two seat panels, means for pivotally supporting said seat panel for movement between an occupant supporting generally horizontal closed position and a generally vertical depending open position at the front of said seat frame forming a toilet aperture, said seat frame providing clearance beneath the seat rearwardly of said depending first panel to enable the wheel chair to be backed over a toilet bowl, and manually operable means supported on one side of said wheel chair and accessible by the user to assist the user in moving said seat panel between said occupant supporting position and said open position, said manually operable means positioned for access by the user including a pivot shaft rotatably supported to said frame and fixed to the front of said first seat panel for cantilevered support of said first seat panel, a crank arm fixedly connected to said pivot shaft laterally outwardly of said seat frame, a toggle linkage including a first link pivotally connected to said crank arm and a second link pivotally connected to said side frame and to said first link, said first and second links being movable between an over center locked position and an off center collapsed position with said first panel depending from said pivot shaft, and wherein said over center position maintains said first panel in the closed occupant supporting position, and stop means to limit said over center linkage position.

2. The improvement of claim 1 wherein said second link has a handle accessible by the occupant to move the links between the over center locked position and the off center collapsed position.

3. A seat assembly for converting and adapting a wheel chair body having generally vertically extending front and rear legs for toilet use said assembly comprising a seat frame having front and rear cross frame members, said cross frame members having end portions adapted for connection to said front and rear legs of said wheel chair two side panels, a central panel, a pivot shaft rigidly connected to said control panel and rotatably housed by said front frame for pivotally supporting said central panel in a contileverid manner to said front frame, linkage means including a handle connected between said front and rear cross frame member and connected to said pivot shaft to accord pivotal movement of said central panel between an open generally vertical position and a closed generally horizontal position, said frame members including integrally formed vertically extending clamp portions having clamp parts oriented to embrace said vertically extending wheel chair legs to secure said side frames in assembly with a four point connection to the side frames.

4. The seat assembly of claim 3 wherein said linkage means forms a toggle and is movable into an over center position to lock said panel in the closed position, said linkage being operative adjacent one of said side panels and above the toilet bowl and to afford clearance beneath the panels so that the wheel chair can be moved over the toilet.

5. The seat assembly of claim 4, wherein said frames include reinforcing ribs with apertures to support said shaft.

* * * * *

UNITED STATES PATENT AND TRADEMARK OFFICE

CERTIFICATE OF CORRECTION

PATENT NO. : 4,514,867

DATED : May 7, 1985

INVENTOR(S) : Neil B. Jensen

It is certified that error appears in the above-identified patent and that said Letters Patent are hereby corrected as shown below:

Claim 1, line 41, after "two" insert ---side---.

Signed and Sealed this

*Twenty-sixth* Day of *August 1986*

[SEAL]

*Attest:*

DONALD J. QUIGG

*Attesting Officer*

*Commissioner of Patents and Trademarks*